US005158123A

United States Patent [19]

Senko

[11] Patent Number: 5,158,123

[45] Date of Patent: Oct. 27, 1992

[54] FLUID FILL CAP

[76] Inventor: Robert D. Senko, c/o Lawrence Stachowski 78 Nancycrest La., West Seneca, N.Y. 14224

[21] Appl. No.: 657,145

[22] Filed: Feb. 19, 1991

[51] Int. Cl.[5] ..... B67C 11/00

[52] U.S. Cl. ..... 141/338; 141/98; 141/340; 184/105.1; 220/86.2; 220/666; 220/720

[58] Field of Search ..... 141/331, 98, 337, 338, 141/340–342, 344, 345, 311 A; 184/1.5, 105.1; 220/86.1, 86.2, 666, 720, 746, DIG. 33; 206/577; 123/198 R; 222/562, 570

[56] References Cited

U.S. PATENT DOCUMENTS

| | | | |
|---|---|---|---|
| 1,408,865 | 3/1922 | Cowell | 141/338 |
| 1,584,574 | 5/1926 | Tye | 220/86.2 |
| 2,578,184 | 12/1951 | Green | 220/86.2 |
| 3,014,621 | 12/1961 | Povitz | 222/570 X |
| 3,016,161 | 1/1962 | Peplin | 220/86.2 |
| 4,157,103 | 6/1979 | La Fleur | 141/98 |
| 4,832,238 | 5/1989 | Taylor | 141/337 X |
| 4,970,817 | 11/1990 | Mansfield | 141/340 |

FOREIGN PATENT DOCUMENTS

| | | | |
|---|---|---|---|
| 0381262 | 1/1908 | France | 141/338 |
| 0619539 | 4/1927 | France | 141/338 |
| 0230659 | 3/1925 | United Kingdom | 141/338 |

*Primary Examiner*—Henry J. Recla
*Assistant Examiner*—Casey Jacyna
*Attorney, Agent, or Firm*—Leon Gilden

[57] ABSTRACT

A fluid fill cap is provided including an intermediate, flexible extensible and retractable bellows housing mounting a cap therein, wherein the cap receives a plurality of spring clip members to maintain the bellows in a compressed configuration. A bottom cap of the organization is formed with a cylindrical conduit adapted for securement to an associated structural component of an automotive internal combustion engine.

3 Claims, 4 Drawing Sheets

FLUID FILL CAP

BACKGROUND OF THE INVENTION

1. Field of the Invention

The field of invention relates to fluid fill apparatus, and more particularly pertains to a new and improved fluid fill cap wherein the same permits maneuvering of the cap for enhanced access of fluid filling relative to an internal combustion engine.

2. Description of the Prior Art

Various fluid fill devices have been utilized in the prior art to provide access to relatively inaccessible components of an internal combustion engine. Such apparatus may be found in U.S. Pat. No. 4,856,568 to Murphey wherein a funnel utilizes an extensible medial bellows portion permitting maneuverability of the uppermost bellows.

U.S. Pat. No. 4,880,140 to Solomon, et al. provides for a cap structure utilizing bellows type neck.

U.S. Pat. No. 4,572,386 to Marcus sets forth a container with an attachable funnel spout.

U.S. Pat. No. 4,560,081 to Adams sets forth a bellows type fill spout mounted underlying a resealable overlying lid.

As such, it may be appreciated that there continues to be a need for a new and improved fluid fill cap as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of fluid fill cap now present in the prior art, the present invention provides a fluid fill cap wherein the same is arranged for mounting to a mechanical component of an internal combustion engine. As such, the general purpose of the present invention, which will be described subsequently in greater detail, is to provide a new and improved fluid fill cap which has all the advantages of the prior art fluid fill caps and none of the disadvantages.

To attain this, the present invention provides a fluid fill cap including an intermediate, flexible extensible and retractable bellows housing mounting a cap therein, wherein the cap receives a plurality of spring clip members to maintain the bellows in a compressed configuration. A bottom cap of the organization is formed with a cylindrical conduit adapted for securement to an associated structural component of an automotive internal combustion engine.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fluid fill cap which has all the advantages of the prior art fluid fill caps and none of the disadvantages.

It is another object of the present invention to provide a new and improved fluid fill cap which may be easily and efficiently manufactured and marketed.

It is a further object of the present invention to provide a new and improved fluid fill cap which is of a durable and reliable construction.

An even further object of the present invention is to provide a new and improved fluid fill cap which is susceptible of a low cost of manufacture with regard to both materials and labor, and which accordingly is then susceptible of low prices of sale to the consuming public, thereby making such fluid fill cap economically available to the buying public.

Still yet another object of the present invention is to provide a new and improved fluid fill cap which provides in the apparatuses and methods of the prior art some of the advantages thereof, while simultaneously overcoming some of the disadvantages normally associated therewith.

Still another object of the present invention is to provide a new and improved fluid fill cap wherein the same is readily mounted to an internal combustion engine.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
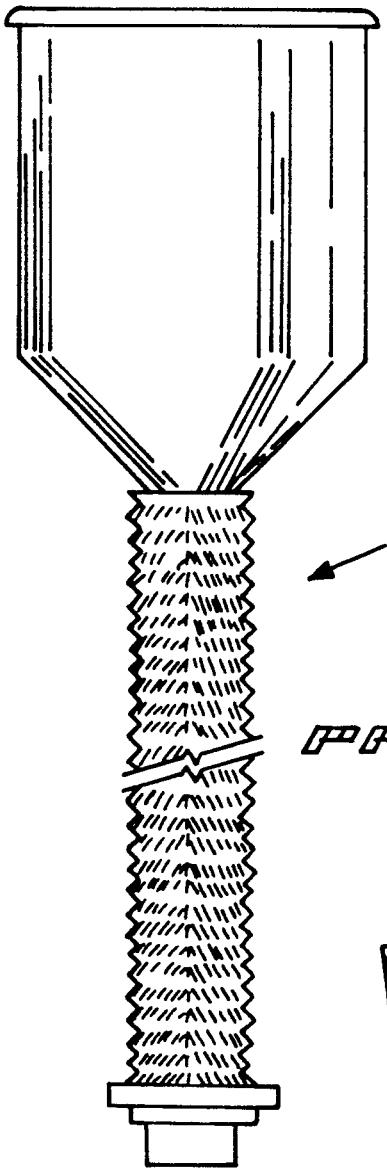
FIG 1 PRIOR ART
FIG. 1 is an orthographic side view, taken in elevation, of a prior art fluid fill apparatus.

With reference now to the drawings, and in particular to FIGS. 1 to 8 thereof, a new and improved fluid fill cap embodying the principles and concepts of the present invention and generally designated by the reference numerals 10–32 will be described.

Figure 2:
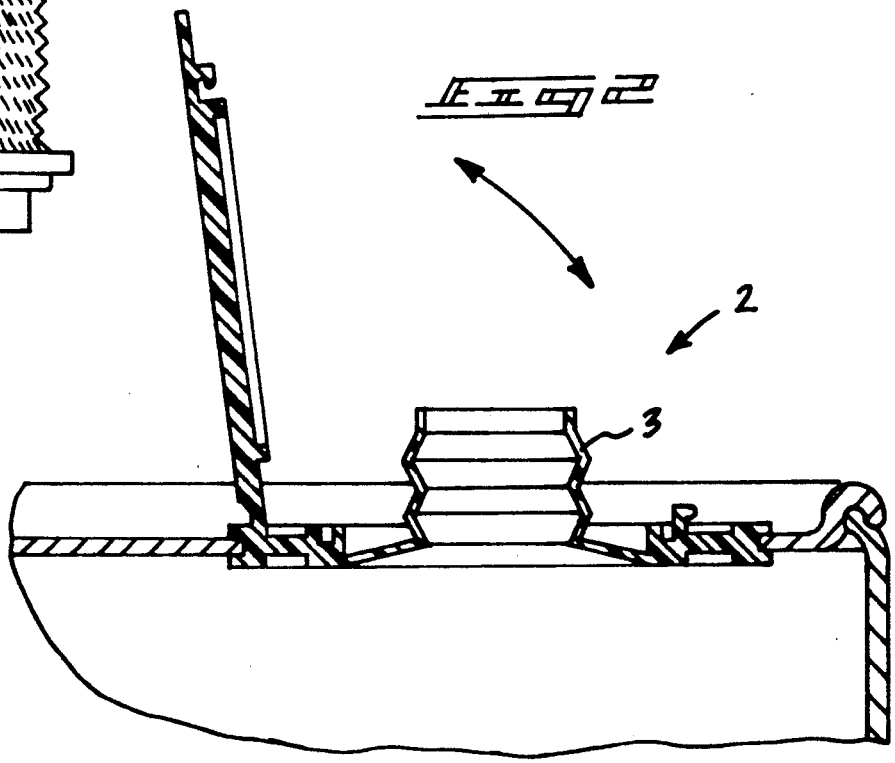
FIG 2 PRIOR ART
FIG. 2 is an orthographic cross-sectional illustration of a further prior art fluid fill organization.
Figure 3:
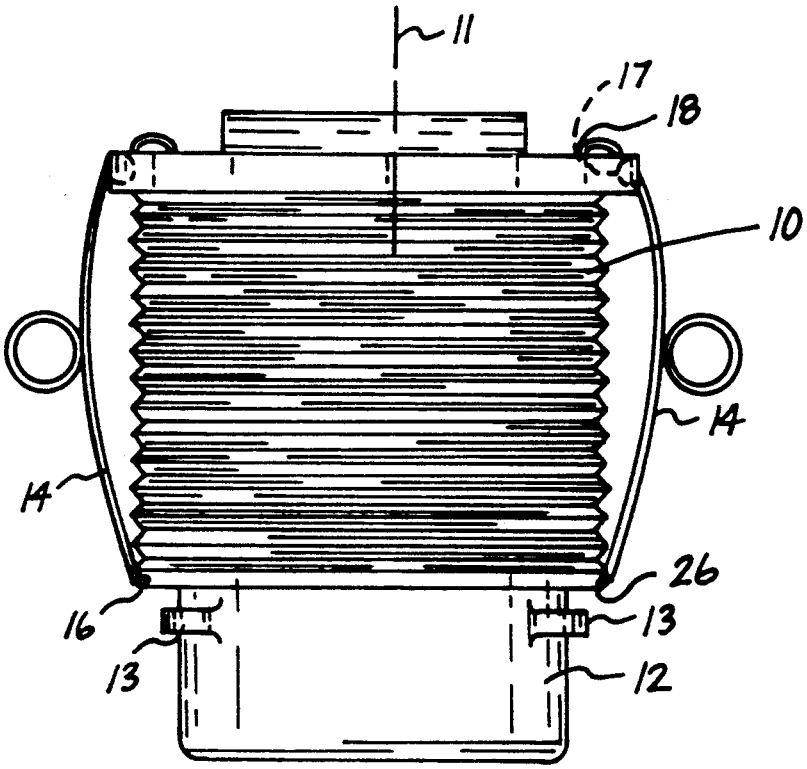
FIG. 3 is an orthographic side view, taken in elevation, of a fluid fill cap of the instant invention.
Figure 4:
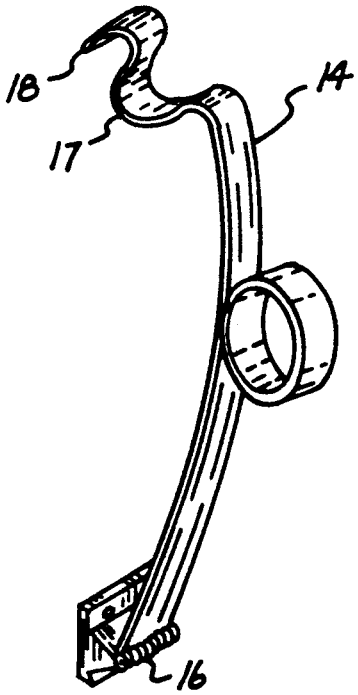
FIG. 4 is an isometric illustration of a spring clip utilized by the fluid fill cap structure of the instant invention.
Figure 5:
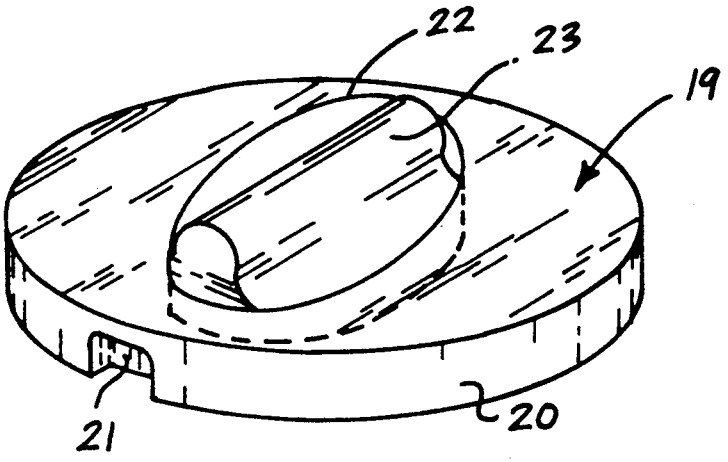
FIG. 5 is an isometric illustration of a top cap structure of the fluid fill cap of the instant invention.
Figure 6:
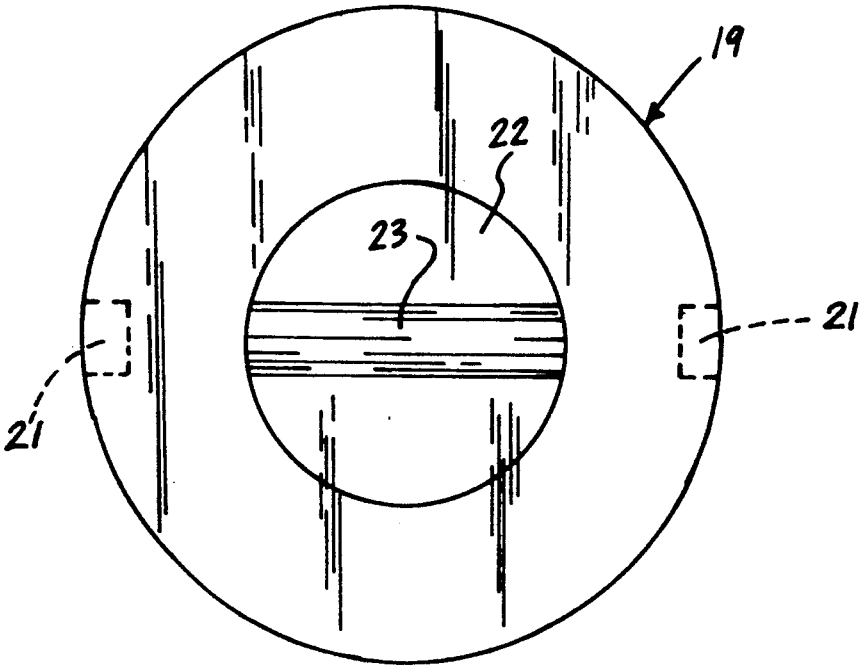
FIG. 6 is a top orthographic view of the top cap of the instant invention.

FIG. 1 illustrates a prior art fluid fill structure as set forth in U.S. Pat. No. 4,856,568, utilizing a central bellows hose permitting maneuverability of the uppermost funnel. FIG. 2 illustrates a further prior art fluid fill organization, as set forth in U.S. Pat. No. 4,560,081, wherein as opposed to the fluid fill structure 1 of FIG. 1, the organization 2 utilizes a bellows conduit 3 underlying a pivotal lid.

Figure 7:
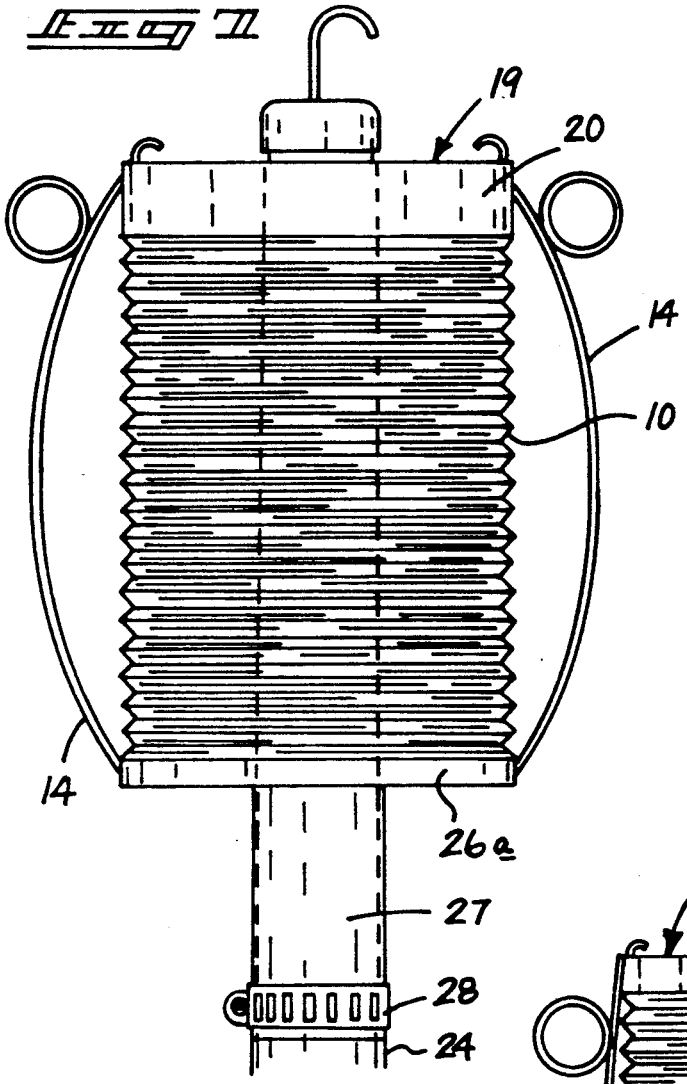
FIG. 7 is an orthographic side view of the fluid fill cap structure of the instant invention arranged for securement of a fluid fill tube such as utilized in an automatic transmission.

More specifically, the fluid fill cap of the instant invention essentially comprises an elongate bellows 10 defined about a central housing axis 11. A first bottom cap plate 26 is mounted to a lower terminal end of the bellows housing orthogonally relative to the axis 11. A first base member 12 defined by a first base member diameter less than the predetermined diameter of the cap plate 26 includes a plurality of mounting ears 13 radially oriented and extending outwardly of the base member 12 for securement to an oil fill cap structure utilized typically in automotive environments (not shown). A plurality of spring clips 14 are diametrically mounted at the lower terminal ends to diametrically opposed sides of the bottom cap plate 26. Each spring clip 14 includes a spring hinge 16 at the lower terminal end of the spring clip pivotally mounting each spring clip to the cap plate 26 wherein an upper terminal spring end 18 is arranged for imposing on a planar top surface of an upper cap 19. The upper cap 19 includes a cylindrical side wall 20 with diametrically opposed recesses 21 directing the side wall 20 to receive an arcuate projection 17 formed to each spring clip adjacent the upper terminal spring end 18. This maintains the bellows in a secure collapsed configuration during periods of non-use. The cap 19 includes a removable central plug 22, with a plug handle 23 to provide access to filling through the cap 19, if desired. FIG. 7 illustrates the organization, including a second bottom cap plate 26 mounting a flexible cap tube 27, wherein the flexible cap tube includes a clamp 28 to secure the cap tube about an associated transmission fill tube 24 typically utilized in automotive transmissions, with the transmission tube directed and projected through the upper cap 19 through the removed central plug 22.

Figure 8B:
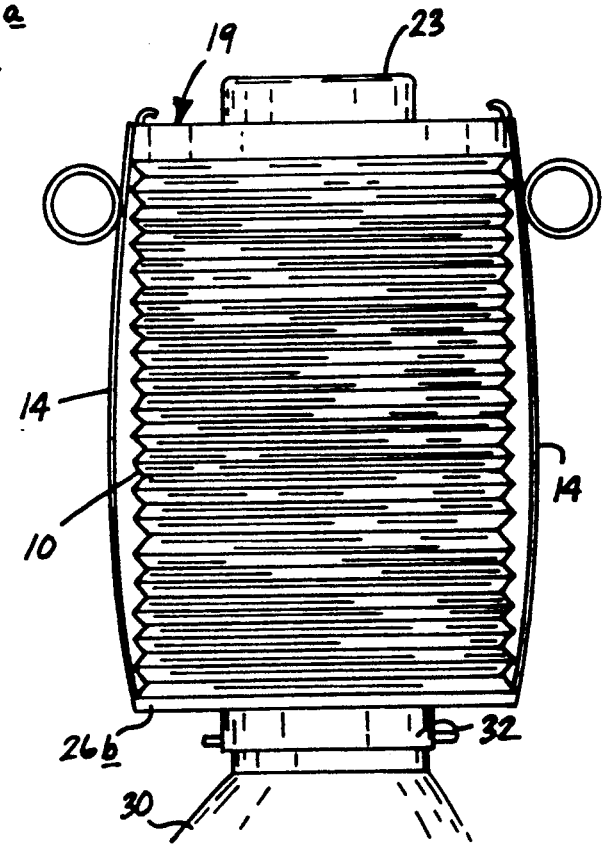
FIG. 8 is an orthographic side view, taken in elevation, of the fluid fill cap of the instant invention for mounting to a power steering pump as utilized in an automotive environment.

FIG. 8 illustrates the organization including a third bottom cap plate 26*b* mounting a cylindrical nozzle 32 of rigid configuration for mounting to a conventional power steering reservoir 30, as utilized in association with an internal combustion engine to power self-propelled vehicles.

It is understood that upon release of the spring clips 14, the bellows may be extended an manipulated as desired for filling of the various components of a conventional internal combustion engine as utilized by contemporary vehicles.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fluid fill cap comprising, an elongate cylindrical bellows housing, the bellows housing adapted for extension and contraction and the bellows housing is formed about a central housing axis, and a rigid base member mounted to a lower terminal end of the bellows housing orthogonally oriented relative to the housing axis, and the base member including a mounting cap thereon, and the mounting cap arranged for securement to a filling component, as utilized in an internal combustion engine, with the mounting cap coaxially aligned relative to the base member, and a top cap, the top cap removably mounted relative to an upper terminal end of the bellows housing overlying the bellows housing, and securement means mounted to the base member for securement to the top cap for effecting collapsing of the bellows member in a compacted configuration, and the securement means includes a plurality of diametrically opposed spring clips, each spring clip including a lower terminal end, each lower terminal end diametrically mounted to opposed sides of the base member, each lower terminal end including a spring hinge mounted thereto to permit pivotal movement of each spring clip relative to the base member, and each spring clip including an elongated arcuate body formed with an upper terminal spring end, the upper terminal spring end in communication with a top surface of the top cap, and each spring clip including an arcuate spring projection positioned adjacent the upper terminal spring end, and the top cap including a cylindrical skirt, the cylindrical skirt including a plurality of diametrically opposed recesses, each recess receiving a respective arcuate projection of each spring clip when the top cap is mounted to the bellows housing.

2. An apparatus as set forth in claim 1 wherein the top cap includes a central removable plug, the central removable plug including a handle to permit removal of the plug when the cap is mounted to the bellows housing.

3. An apparatus as set forth in claim 2 wherein the mounting cap is defined as a flexible cap tube for surrounding securement relative to a fill tube, the cap tube including a clamp in surrounding relationship relative to the flexible cap tube at a lower terminal end thereof for securement of the flexible cap tube to the fill tube.

* * * * *